US005957140A

United States Patent [19]

McGee

[11] Patent Number: 5,957,140

[45] Date of Patent: Sep. 28, 1999

[54] HAIR STYLING IRON FOR STRAIGHTENING AND CURLING

[76] Inventor: Robert J. McGee, 28 Denise Dr., Florissant, Mo. 63033

[21] Appl. No.: 09/196,299

[22] Filed: Nov. 19, 1998

[51] Int. Cl.[6] ..... A45D 1/00; A45D 2/12; A45D 1/04; A45D 26/00

[52] U.S. Cl. ..... 132/224; 132/232; 132/226; 219/225; 219/222; 219/223

[58] Field of Search ..... 132/224, 226, 132/225, 232, 223; 219/221, 222, 223, 224, 225

[56] References Cited

U.S. PATENT DOCUMENTS 1,398,637 11/1921 Fuchs-Maurer .
1,459,132 3/1923 Alice .
1,588,241 2/1926 Leland .
1,701,660 2/1929 Bingham .
1,719,232 7/1929 Meade ..... 219/222
5,091,629 2/1992 McGee .
5,223,694 6/1993 Tsuji et al. .
5,357,988 10/1994 Nakamura .

*Primary Examiner*—John J. Wilson
*Assistant Examiner*—Trang Doan
*Attorney, Agent, or Firm*—Greensfelder, Hemker & Gale, P.C.

[57] ABSTRACT

A hair styling iron for straightening and curling hair is provided. The iron is comprised of a pair of tongs having a first blade member with a flat portion and a barrel portion, and a second blade having a flat portion and a channel portion. The blades come together when the tongs are closed, with the flat portions engaging and the barrel portion being received within the channel portion. Thus, one half of the length of the tong blades is flat for straightening hair and the other half is barrel shaped for curling the hair. This arrangement allows the steps of straightening and curling to be carried out with just one set of irons.

7 Claims, 8 Drawing Sheets

HAIR STYLING IRON FOR STRAIGHTENING AND CURLING

BACKGROUND OF THE INVENTION

When styling hair, it is desirable to be able to curl the hair in a wide variety of styles. Oftentimes, however, it is necessary to first straighten the hair to remove the natural kinks or curls to make the hair more manageable. Afterwards, the hair may be curled in many different styles. Heated curling irons are commonly used for these purposes. However, to carry out the two steps of straightening and curling, multiple irons have generally been required to carry out the separate steps. This slows down the hair styling process and creates other efficiency problems by having to constantly change irons.

There exist certain combined hair straightening and curling irons but they have drawbacks. One type of such iron comprises semi-circular barrels having a flat inner portions. The flat inner portions come together over the hair for straightening, and do an adequate job for that purpose. However, when the hair is held between the flat portions while curling around the outer barrel portions, an unwanted crease, or "fish hook", in the hair results at the point of contact with the area on the iron where the flat portion meets the barrel portion. Other irons exist which incorporate flat portions which come together over the hair for straightening, and a third barrel-shaped element which closes on to the outer barrel surface of one of the flat portions for curling. This arrangement can be cumbersome in that the iron must be manipulated to be switched between either the straightening or the curling mode. Thus, for each step, a different arrangement of the three part iron must be set up which can also cause efficiency problems.

SUMMARY OF THE INVENTION

Is therefore an object of this invention to provide a hair styling iron that can combine the features of being able to straighten and curl the hair, and to carry out such steps without having to change the configuration of the iron. The iron is comprised of a set of tongs having a pair of blade members. One of the blades has a flat surface portion at its far, or distal, end and a barrel portion at its near, or proximal, end. The other blade has a similar flat surface portion at its far end, with a channel portion at its near end for receiving the barrel portion of the first blade when the tongs of the styling iron are closed.

With the inventive styling iron, a section of hair can be treated with the straightening and curling steps with the same iron, in immediate succession, without having to make any changes to the iron. For the straightening step, the section of hair is placed between the flat portions of the blades, as the closed iron is drawn along the section of hair. For the curling step, the blades are released and merely repositioned across the section of hair so that the barrel portion and channel portion are closed over the hair.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
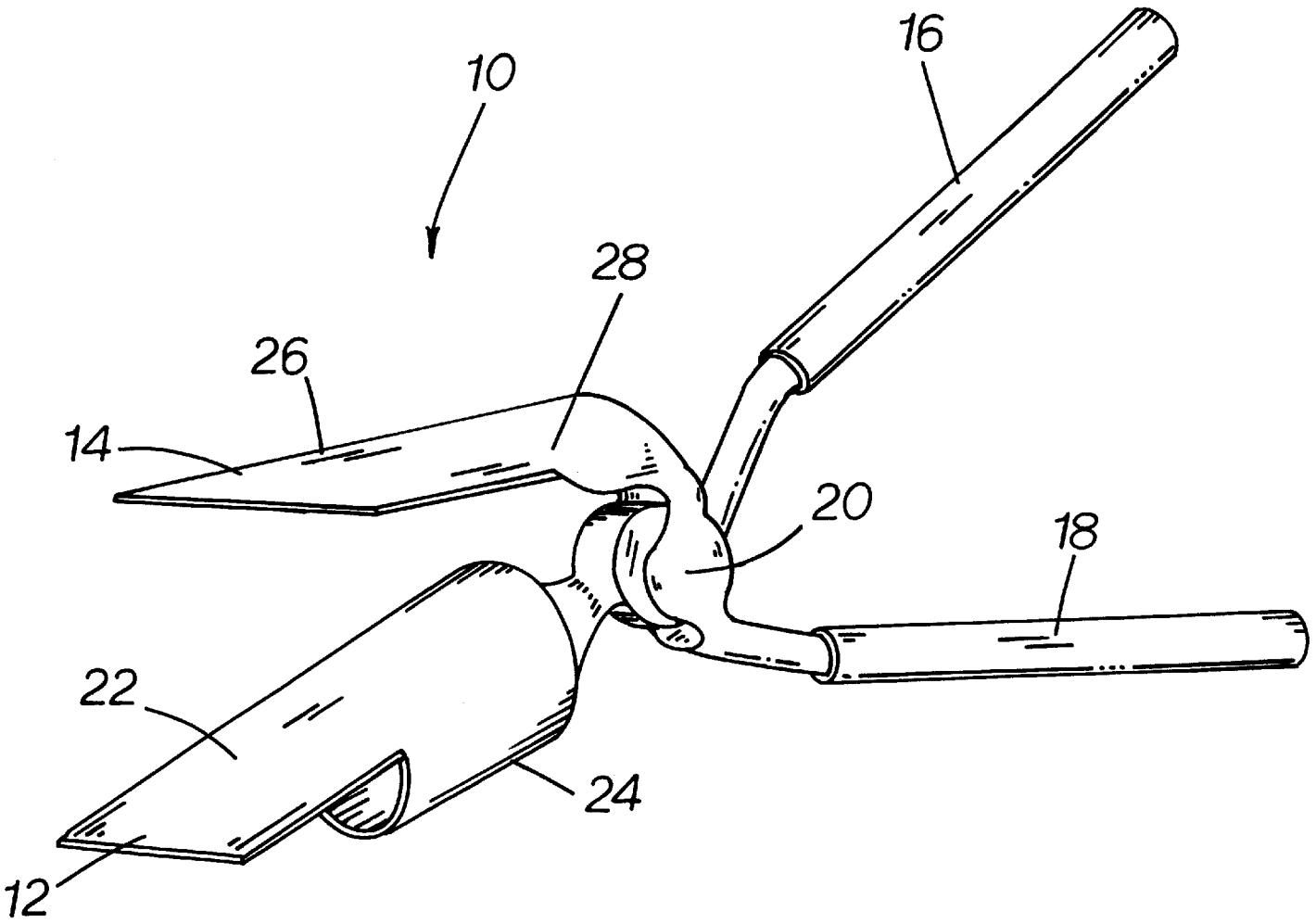
FIG. 1 is a perspective view of the irons from the front and to the side, showing the tong blades open.
Figure 2:
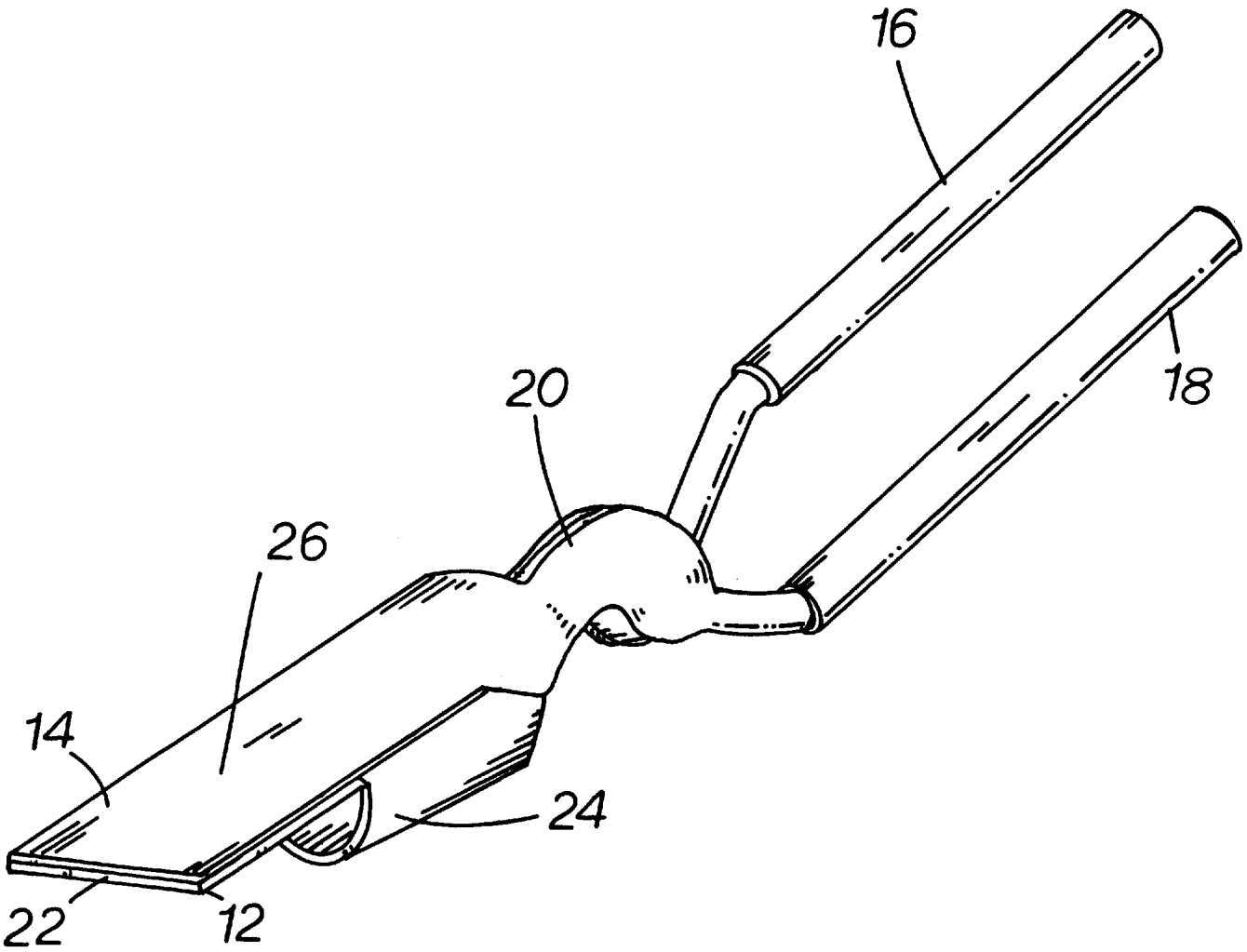
FIG. 2 is a perspective view of the irons from the front and to the side, with the tong blades closed.
Figure 3:
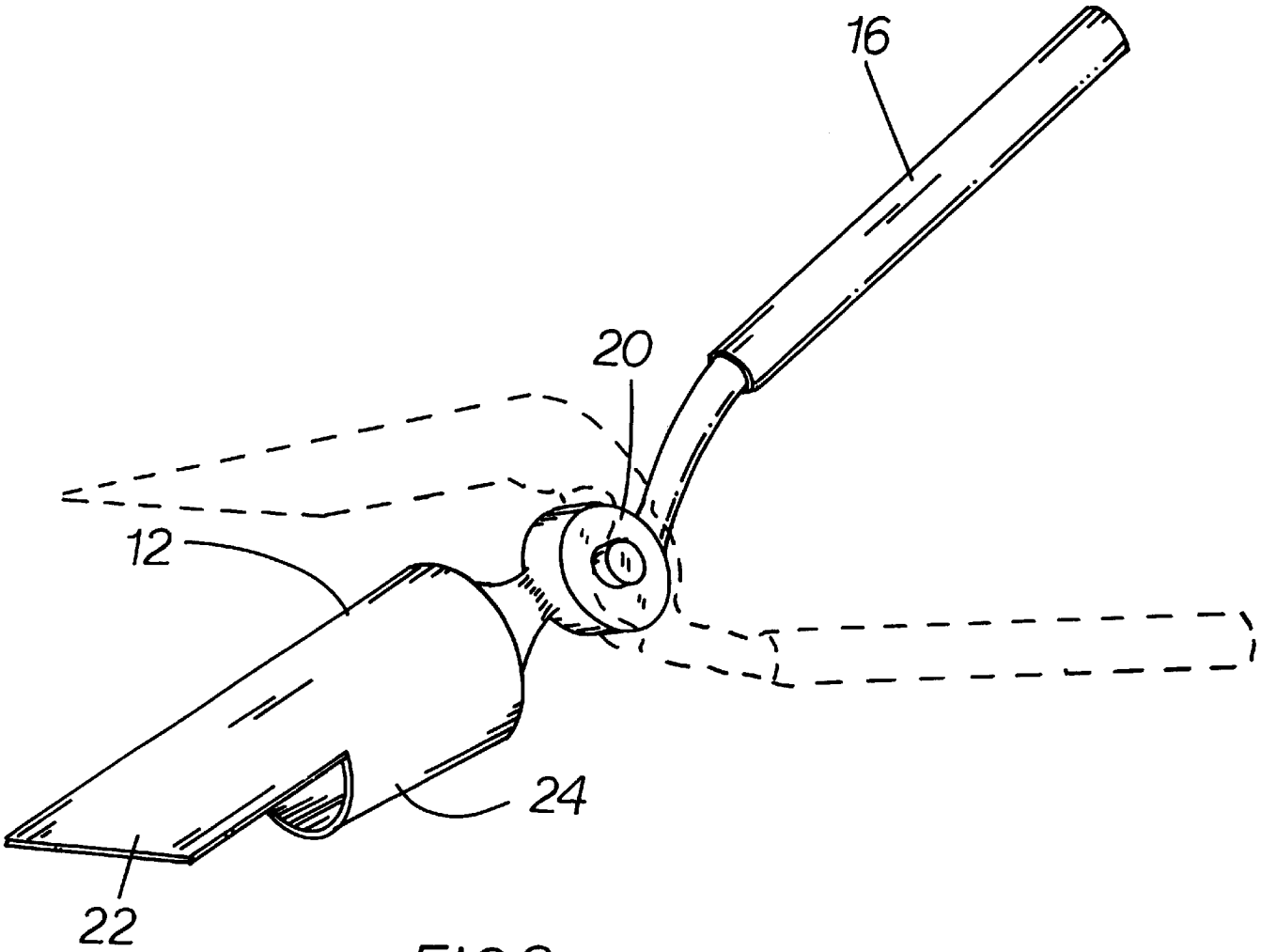
FIG. 3 is a perspective view of the lower blade of the tongs, with the upper blade shown in phantom.
Figure 4:
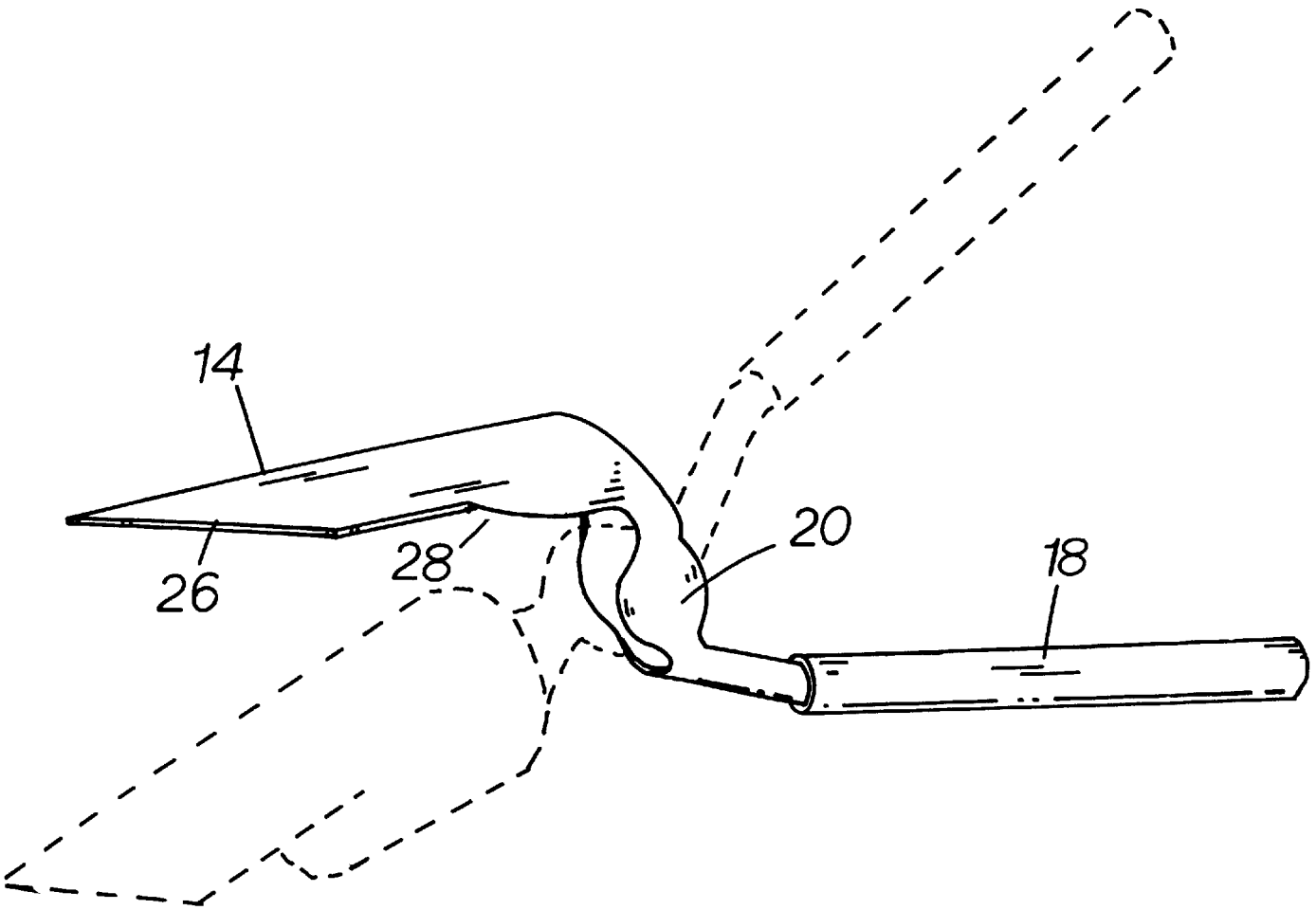
FIG. 4 is a perspective view of the upper blade of the tongs, with the lower blade shown in phantom.
Figure 5:
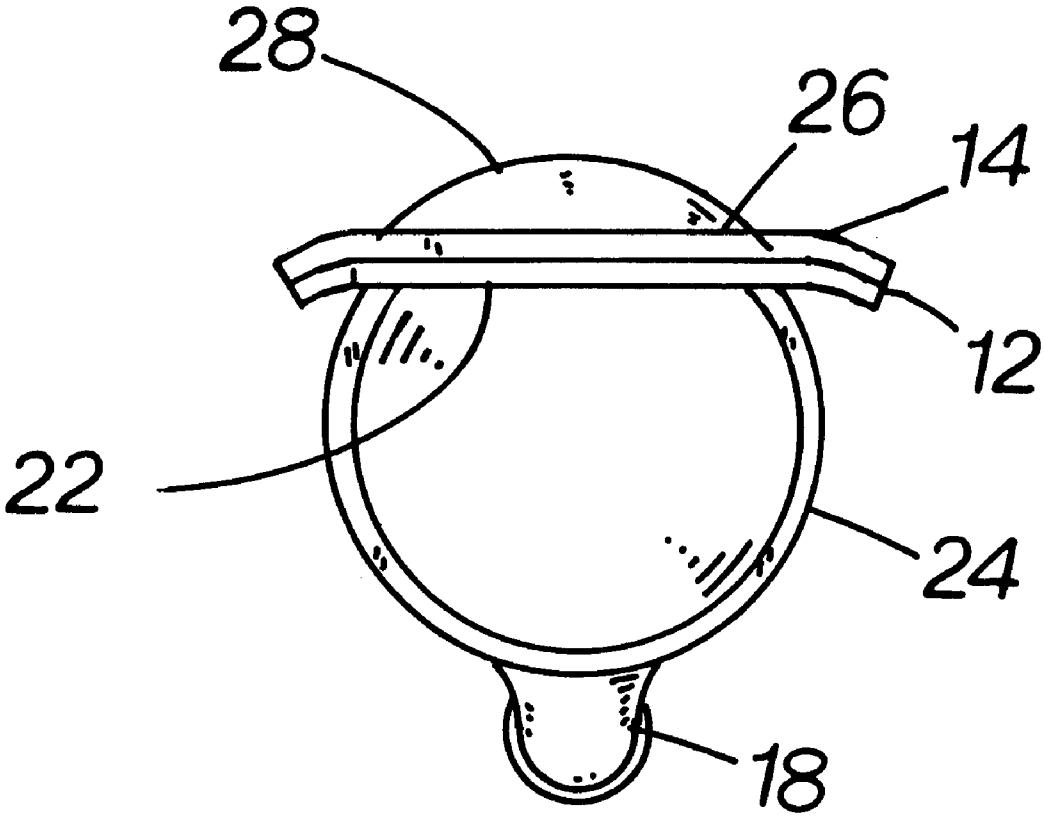
FIG. 5 is a view in side elevation from the front showing the tong blades closed.

The hair styling iron 10 of the present invention is generally shown in FIG. 1. It is comprised of a pair of tongs having blade members 12 and 14, each having handle members 16 and 18, respectively. The tongs pivot at connection 20 to allow the blade members to open and close by manipulation of the handles. Blade member 12 has a flat surface portion 22 and a barrel portion 24, each portion forming about one half the length of the blade. Flat portion 22 can be relatively thin and is generally planiform, although FIG. 5 shows this portion as having slightly bevelled edges. Barrel portion 24 may be hollow and has on overall cylindrical shape. Blade member 14 has a flat surface portion 26 and a channel portion 28, each portion similarly forming about one half the length of the blade. Likewise, flat portion 26 can be relatively thin and is generally planiform, and channel portion 28 has a partially cylindrical shape for receiving barrel portion 24 when the tongs are closed as shown in FIG. 2.

This type of styling iron must be separately heated by an external heating source, such as an oven, heat bath or other appropriate means. Because the tongs are comprised of metal, weight becomes a concern. Heavy curling irons pose problems in that the hands and the arms of the stylist can become fatigued after a short time. When this happens, the quality of the stylist's work can be impaired. Accordingly, the construction of the tongs should minimize the amount of metal used. For this reason, the barrel portion of the iron is hollow and the blade portions are kept thin. Thus, if two separate irons are used, each must be kept constantly hot because the irons have a tendency to cool off relatively quickly. It is somewhat burdensome and time-consuming to constantly change between flat and curling irons, and to have to continually replace each iron in the heat source between uses. With the dual flat iron and curling iron construction of the instant invention, the straightening and curling steps can take place in immediate succession with the same iron, saving a considerable amount of time and movement. Also, when used in immediate succession, as is its advantage, there is less time for heat dissipation of the irons, and styling can take place faster.

USE

Figure 6:
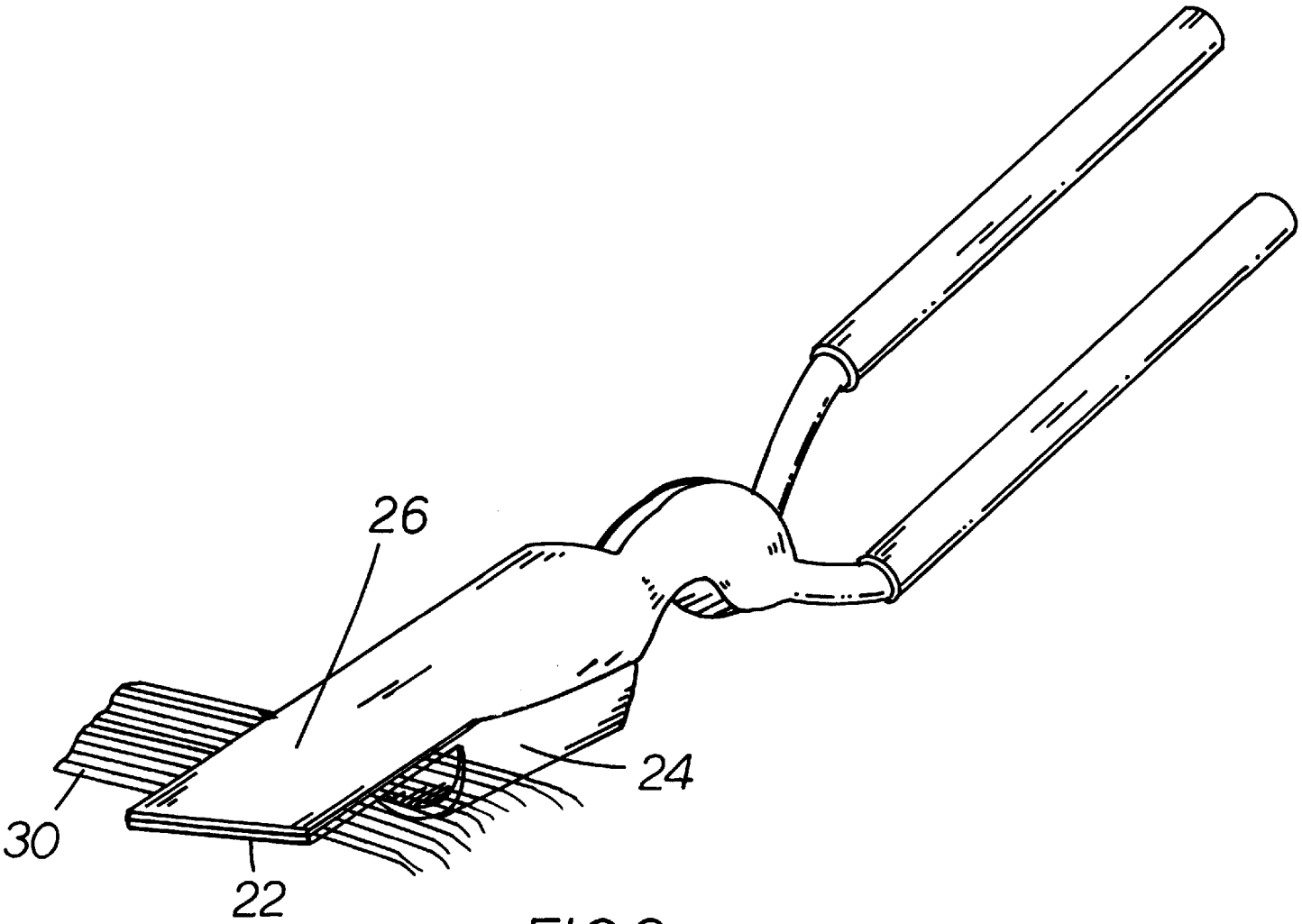
FIG. 6 is a perspective view showing a section of hair being pulled along the flat portion of the tong blades.
Figure 7:
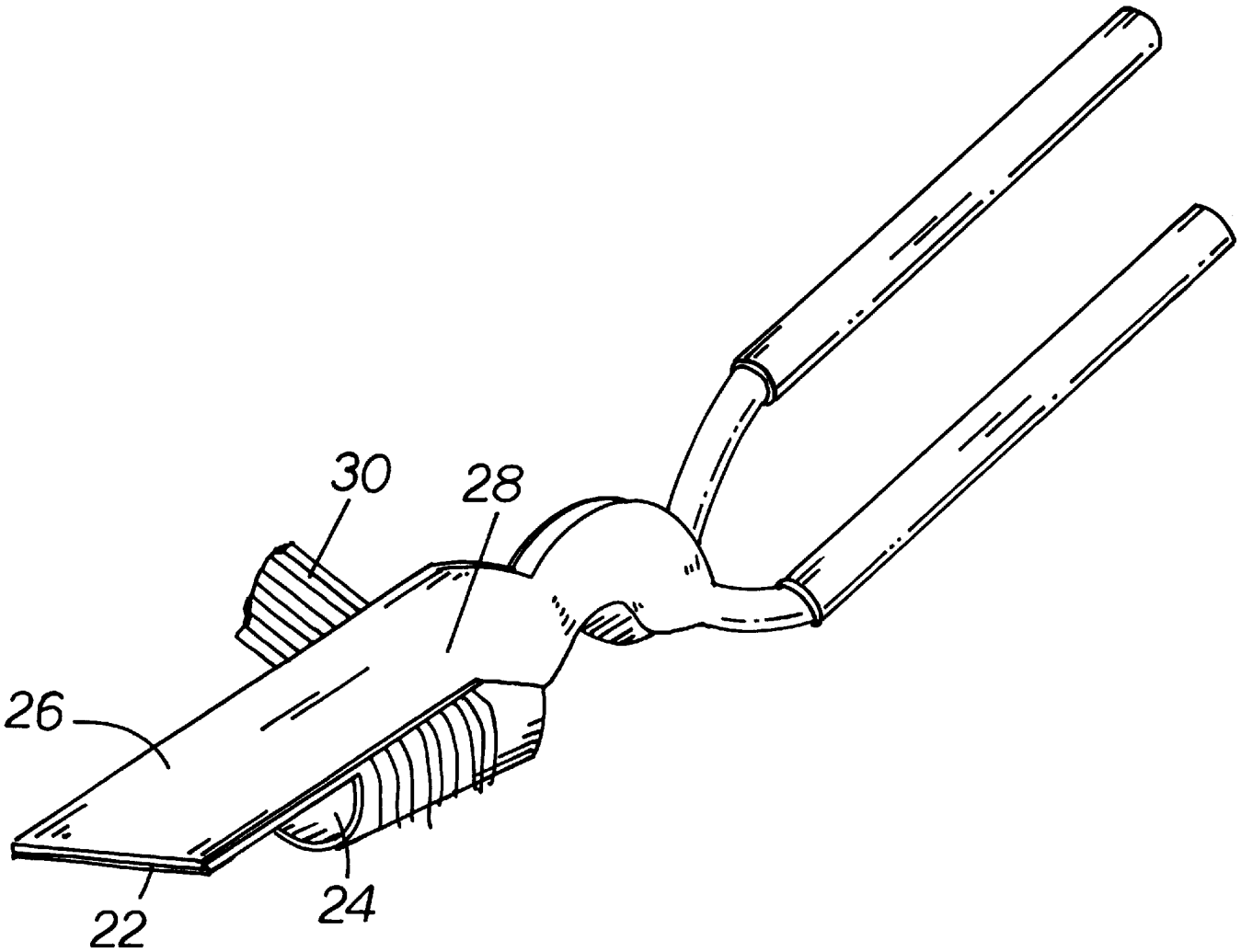
FIG. 7 is a perspective view showing a section of hair being pulled and wrapped along the barrel portion of the tong blades.
Figure 8:
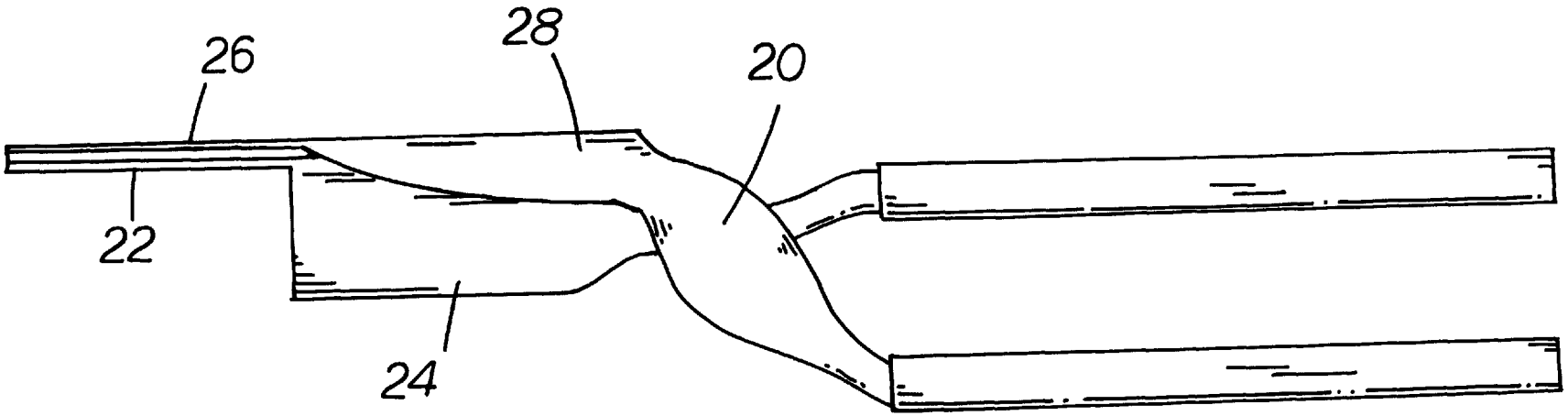
FIG. 8 is a view in side elevation from the side showing the tong blades closed.

As can be seen in FIGS. 6 and 7, the hair styling tongs are effective for combining the steps of straightening and curling the hair with just one set of irons. With the irons preheated, a three or four inch section of hair 30 is placed between the flat surface portion 22 of blade member 12 and the flat surface portion 26 of blade member 14 as shown in FIG. 6 to effect straightening of the hair as the iron is drawn down along the section of hair. To give a bevelled aspect to the hair, the edges of the respective flat portions of the tong blades may be slightly curved, which are shown in FIG. 5. Immediately following the straightening step, the curling step can then take place using the irons. The section of hair 30 is simply moved laterally along the blades and is placed between the barrel portion 24 of blade member 12 and the channel portion 28 of blade member 14 as shown in FIG. 7. Because the hair is gripped between cylindrical members, as opposed to flat members, the unnatural crease, or "fish hook", in the hair is avoided as it is rolled around the barrel portion, and a proper and shapely curl is achieved. The complementary engagement of the barrel portion 24 and channel portion 28 provides such a cylindrical gripping effect as seen in FIG. 5.

The styling irons of the present invention can come in various sizes to achieve different styling techniques. If desired, the positioning of the respective flat portions and barrel portions of the tongs can be reversed, such that the barrel portions are at the end of the blades with the flat portions towards the handles.

Various changes and modifications may be made within this invention as will be apparent to those skilled in the art. Such changes and modifications are within the scope and teaching of this invention as defined in the claims appended hereto.

What is claimed is:

1. A hair styling iron comprising a pair of tongs having first and second blade members, each of said first and second blade members having a handle, said blade members being pivotally connected to allow movement therebetween from open to closed positions by manipulating said handles, said first blade member comprising a flat surface portion and a barrel portion, said second blade member comprising a reciprocal flat surface portion and a channel portion having a partially cylindrical shape, said flat surface portion of said first blade member and said reciprocal flat surface portion of said second blade member each having straight side edges and being adapted to engage with each other when said respective blade members are moved to said closed position, said barrel portion of said first blade member being adapted to be received within said channel portion of said second blade member when said respective blade members are moved to said closed position, said flat surface portions being adapted to receive therebetween a section of hair against said side surfaces, whereby a straightening effect is imparted to said hair.

2. The hair styling iron of claim 1 in which said flat surface portion of said first blade member and said reciprocal flat surface portion of said second blade member are at respective distal ends of said blade members, and said barrel portion of said first blade member and said channel portion of said second blade member are at respective proximal ends of said blade members.

3. The hair styling iron of claim 2 in which said flat surface portion of said first blade member and said reciprocal flat surface portion of said second blade member comprise approximately a first half of a length of said blade members, and said barrel portion of said first blade member and said channel portion of said second blade member comprise approximately a second half of said length of said blade members.

4. The hair styling iron of claim 2 in which said flat surface portions of said blade members are planiform.

5. The hair styling iron of claim 4 in which said flat surface portions of said blade members have slightly bevelled edges.

6. The hair styling iron of claim 2 in which said barrel portion of said first blade member is hollow.

7. The hair styling iron of claim 3 in which said flat surface portions of said blade members are planiform, and said barrel portion of said first blade member is hollow.

* * * * *